US008684713B2

(12) United States Patent
Lio

(10) Patent No.: US 8,684,713 B2
(45) Date of Patent: Apr. 1, 2014

(54) ROTOR TYPE PUMP

(76) Inventor: Pang-Chian Lio, Miaoli County (TW)

( * ) Notice: Subject to any disclaimer, the term of this patent is extended or adjusted under 35 U.S.C. 154(b) by 175 days.

(21) Appl. No.: 13/381,527

(22) PCT Filed: Aug. 27, 2010

(86) PCT No.: PCT/CN2010/076415

§ 371 (c)(1),
(2), (4) Date: Dec. 29, 2011

(87) PCT Pub. No.: WO2011/035677

PCT Pub. Date: Mar. 31, 2011

(65) Prior Publication Data

US 2012/0189481 A1 Jul. 26, 2012

(30) Foreign Application Priority Data

Sep. 23, 2009 (CN) ..... 2009 1 0174216

(51) Int. Cl.
*F03C 4/00* (2006.01)
*F04C 2/00* (2006.01)
*F04C 15/00* (2006.01)

(52) U.S. Cl.
USPC ..... 418/140; 418/11; 418/63; 418/243; 418/246; 418/270

(58) Field of Classification Search
USPC ..... 418/140, 5, 11, 29, 63, 151, 243, 246, 418/249, 270
See application file for complete search history.

(56) References Cited

U.S. PATENT DOCUMENTS 151,472 A * 6/1874 Chavous ..... 418/243
154,298 A * 8/1874 Teal ..... 418/212
1,698,815 A * 1/1929 Jaworowski ..... 418/60
3,649,141 A * 3/1972 Belcher ..... 418/249
3,813,193 A * 5/1974 Rinehart ..... 418/63
6,729,864 B2 * 5/2004 Eley ..... 418/243
6,824,367 B2 * 11/2004 Matsumoto et al. ..... 418/11

FOREIGN PATENT DOCUMENTS

CN 2156304 Y 2/1994
CN 2558791 Y 7/2003
CN 2767709 Y 3/2006
CN 101105174 A 1/2008
EP 0008531 A1 3/1980
JP 63189684 A * 8/1988 ..... 418/243

OTHER PUBLICATIONS

International Search Report for PCT/CN2010/076415 dated Nov. 15, 2010.

* cited by examiner

*Primary Examiner* — Theresa Trieu
(74) *Attorney, Agent, or Firm* — WPAT, P.C.; Anthony King

(57) ABSTRACT

A rotor type pump is provided. A rotor rotates and closely contacts an inner surface of a chamber, and a cam controls a sealing part, so that during a compression procedure, the sealing part, a convex surface of the rotor, and an inner surface of the chamber form a substantially hermetic space, and when a gas in the chamber is compressed to a set pressure, the compressed gas is guided out. Therefore, a smooth surface of the rotor closely contacts the inner surface of the chamber, and the gas in the chamber is compressed in a rotational manner, in which the to-and-fro movement of a piston is not required, and a dead point is prevented, so that operation is smooth and noise is not easily generated. Further, the rotor type pump does not need to use a lubricating fluid and offers extremely large compression capacity and excellent efficiency.

15 Claims, 11 Drawing Sheets

ROTOR TYPE PUMP

BACKGROUND OF THE INVENTION

1. Field of the Invention

The present invention relates to a rotor type pump, and more particularly to a rotating rotor type pump.

2. Description of the Related Art

High pressure gas (for example, air) has wide applications across various fields, for example, engine pressurization, pneumatic tools, high pressure cleaning tools, and dynamic force operated on instruments. In the prior art, gas compression is performed by a motor utilized to drive a piston in a cylinder to-and-fro, in which a normal pressure gas is provided into a hermetic space formed by the cylinder and the piston. As the piston moves to reduce the volume of the hermetic space, the normal pressure gas is compressed into a high pressure gas, and the compressed high pressure gas is evacuated for storage in an air reservoir.

Existing compression devices are commonly piston type. When the piston is moved to-and-fro, an upper dead point and a lower dead point are generated at the locations where the piston reverses direction. The existing piston type compression device thus operates in a relatively jerky manner, and may generate substantial noise. Further, in the existing compression device, a lubricating fluid must be disposed in the cylinder, so as to reduce friction and enable the piston to perform the to-and-fro movement smoothly in the cylinder. When the lubricating fluid is absent or insufficient, extreme friction may be generated between the piston and the cylinder, thereby affecting compression efficiency, or even damaging the structure of the cylinder or causing excessively high temperature, thereby sintering the piston and the cylinder.

Therefore, there is need for a rotor type pump to solve the above problem.

SUMMARY OF THE INVENTION

The present invention provides a rotor type pump to solve various problems in the prior art.

The present invention provides a rotor type pump, which includes a body, a rotor, at least one cam, and a sealing unit. The body has a chamber, an air inlet portion, and an air outlet portion. The rotor is axially disposed in the chamber, the rotor has a peripheral surface, the peripheral surface at least has a convex surface, and the convex surface closely contacts an inner surface of the chamber. Each cam has a cam surface, and the cam rotates in cooperation with the rotor. The sealing unit has a sealing part and at least one synchronizing part, the sealing part contacts the peripheral surface, the synchronizing part contacts the cam surface, and the sealing part moves in synchronization with the synchronizing part. The rotor and the cam rotate, the synchronizing part moves according to the corresponding cam surface, so that the sealing part moving in synchronization continuously closely contacts the peripheral surface, a gas enters the chamber from the air inlet portion, after which the convex surface rotates to seal the air inlet portion, the sealing part, the convex surface, and the inner surface of the chamber to form a substantially hermetic space, and the rotating rotor continuously compresses the gas in the chamber until it reaches a set pressure, after which the gas in the chamber is guided out through the air outlet portion.

In the rotor type pump of the present invention, a smooth surface of the rotor closely contacts the inner surface of the chamber, and the gas in the chamber is compressed in a rotation manner, in which the rotor of the present invention does not need to engage in the to-and-fro movement performed by a piston, and dead points are prevented, so that operation is smooth and less noise is generated. Further, the rotor type pump of the present invention may include a lubricating and heat-resistant cover layer on the surface of the rotor to eliminate the need for lubricating fluid, and offers high compression capacity and excellent efficiency.

PREFERRED EMBODIMENT OF THE PRESENT INVENTION

In order to make technical features, objectives, and effects of the present invention more comprehensible, a detailed description of the present invention is given below by reference to the accompanying drawings.

Figure 1A:
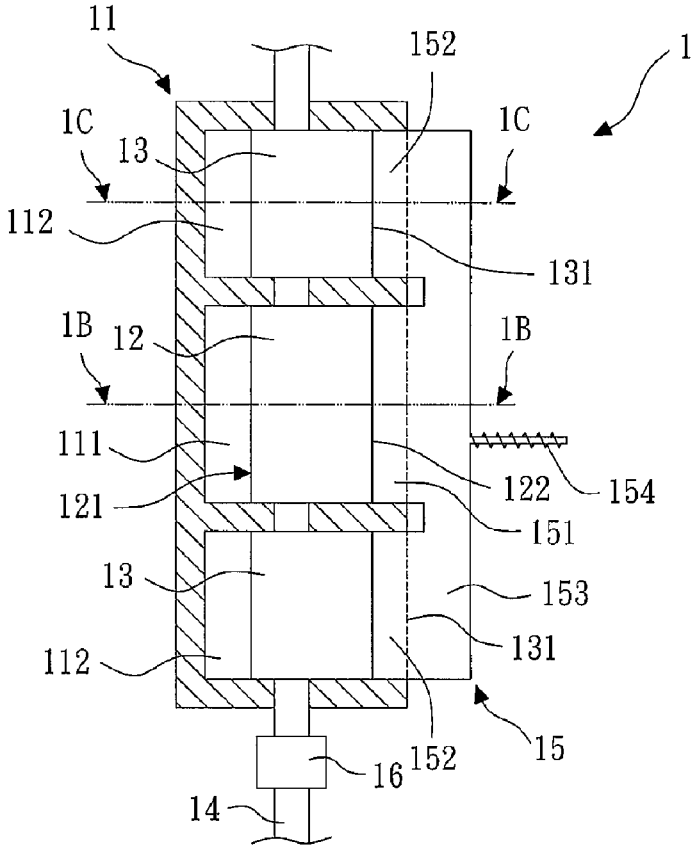
FIG. 1A is an axial cross-sectional view of a rotor type pump according to a first embodiment of the present invention.
Figure 1B:
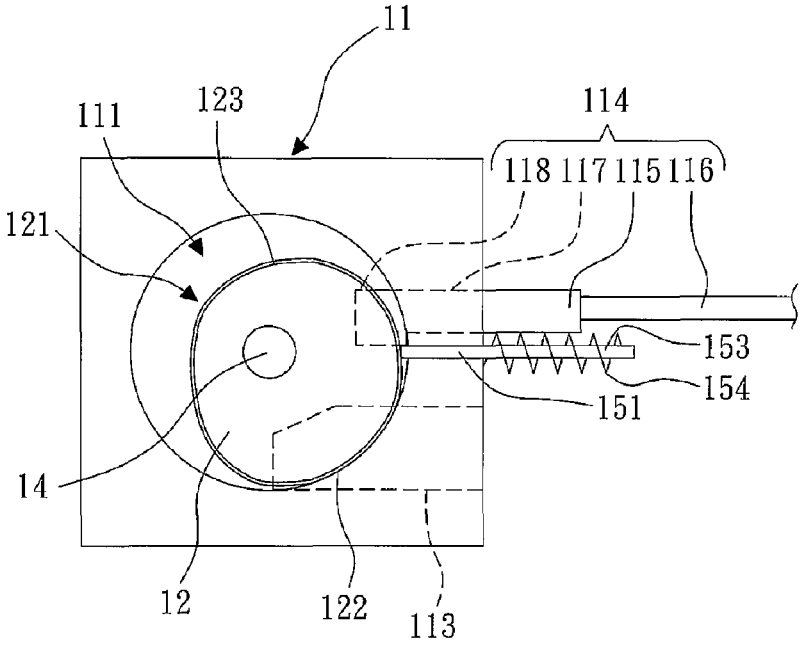
FIG. 1B is a cross-sectional view along 1B-1B in FIG. 1A.
Figure 1C:
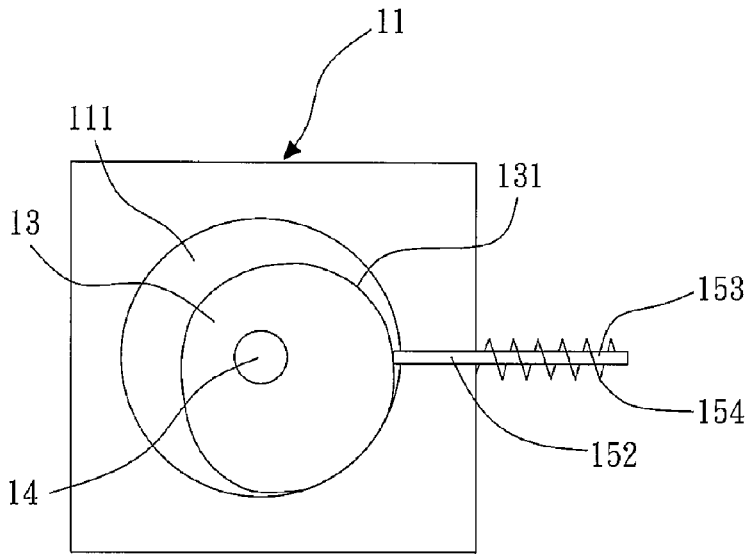
FIG. 1C is a cross-sectional view along 1C-1C in FIG. 1A.

A rotor type pump according to the present invention includes a body, a rotor, at least one cam, and a sealing unit. The body has a chamber, an air inlet portion, and an air outlet portion. The sealing unit has a sealing part and at least one synchronizing part. FIG. 1A is an axial cross-sectional view of a rotor type pump according to a first embodiment of the present invention, FIG. 1B is a cross-sectional view along 1B-1B in FIG. 1A, and FIG. 1C is a cross-sectional view along 1C-1C in FIG. 1A. Referring to FIG. 1A to FIG. 1C, in this embodiment, the rotor type pump 1 includes a body 11, a rotor 12, two cams 13, a rotating shaft 14, and a sealing unit 15. The body 11 has a chamber 111, two accommodating spaces 112, an air inlet portion 113, and an air outlet portion 114, in which the accommodating spaces 112 are disposed on two sides of the chamber 111. It may be understood that the body 11 may only include one accommodating space 112, and the accommodating space 112 is disposed on one side of the chamber 111.

In this embodiment, the chamber 111 is a hollow circular cylinder space, though it should be noted that the chamber 111 and the rotor 12 may have any shapes in cooperation with each other, that is, the shape of the chamber 111 is not limited to be the hollow circular cylinder space. A gas enters the chamber 111 from the air inlet portion 113, the air outlet portion 114 has a check valve 115 and a pipeline 116, the check valve 115 communicates with an inner part of the chamber 111, so that the gas may be guided out from the chamber 111 and cannot enter the chamber 111 reversely, and the pipeline 116 is connected to the check valve 115, for guiding the gas guided out from the chamber 111.

In this embodiment, the air outlet portion 114 includes an out connection channel 117 and an interconnection channel 118. The check valve 115 is connected to the out connection channel 117. The out connection channel 117 is opened to a set depth from one side wall of the body 11, the interconnection channel 118 communicates with the out connection channel 117 and is opened toward a direction of the chamber 111 to break over the chamber 111 (form a channel substantially being an L shape). Preferably, a cross-section size of the interconnection channel 118 is greater than a cross-section size of the out connection channel 117, and the interconnection channel 118 is opened to communicate with a peripheral edge part of the chamber 111.

The rotor 12 is axially disposed in the chamber 111. In this embodiment, a cross-section of the rotor 12 is a cam shape, rotating with a designed center. The rotor 12 has a peripheral surface 121, the peripheral surface 121 at least has a convex surface 122, and the convex surface 122 closely contacts an inner surface of the chamber 111. In this embodiment, the cams 13 are connected to the rotor 12 through the rotating shaft 14, the rotor 12 and the cam 13 are of a coaxial cam type, and the rotor 12 and the cam 13 have the same line type. Each cam 13 has a cam surface 131, and the cams 13 rotate in cooperation with the rotor 12 (in this embodiment, in synchronization with the rotor 12).

At least one of the rotor 12 and the cam 13 further has a cover layer. In this embodiment, only the peripheral surface 121 of the rotor 12 has a cover layer 123, and the cam 13 does not have a cover layer. In other applications, both the rotor 12 and the cam 13 may have a cover layer (not shown in the drawings). Preferably, the cover layer 123 is of a Teflon material. The cover layer 123 may improve lubrication degree and sealing degree between the convex surface 122 and the inner surface of the chamber 111, and may reduce friction generated between the rotor 12 and the inner surface of the chamber 111, thereby improving compression efficiency, preventing damage to the structure of the chamber 111, and preventing the rotor 12 and the chamber 111 from being sintered.

The rotating shaft 14 is connected to the rotor 12 and the cams 13. The rotating shaft 14 is connected to a rotating power source (not shown), which drives the rotor 12 and the cams 13 through the rotating shaft 14. In this embodiment, the rotating shaft 14 is located on an axis line of the rotor 12 and the cams 13, that is, the rotor 12 and the cams 13 are coaxially disposed.

The rotor type pump 1 may further include at least one weighting element 16, used to balance rotation, so as to improve a rotating speed. Preferably, the weighting element 16 is disposed on the rotating shaft 14. Through suitable configuration of the weighting element 16 (for example, set weight and position) (in this embodiment, disposed on a right side of the right cam 13 in FIG. 1), the rotation may be balanced, and the rotating speed may be improved, so that in addition to improving the rotating speed of the rotor 12, the weighting element 16 may stabilize the rotation of the rotor 12 and the cams 13. It may be understood that in other applications, the rotor type pump 1 may further include a plurality of weighting elements disposed on the rotating shaft 14 and located on two sides of the rotor 12 (respectively located on two sides of the body 11).

In this embodiment, the sealing unit 15 has a sealing part 151, two synchronizing parts 152, a base portion 153, and a returning mechanism 154. The sealing part 151 contacts the peripheral surface 121, the synchronizing parts 152 respectively contact the cam surfaces 131, and the sealing part 151 moves in synchronization with the synchronizing parts 152.

In this embodiment, the sealing part 151 penetrates the body 11 and contacts the peripheral surface 121 of the rotor 12 and is located between the air inlet portion 113 and the air outlet portion 114. The synchronizing parts 152 respectively penetrate the body 11 and respectively contact the cam surfaces 131. The base portion 153 is connected to the sealing part 151 and the synchronizing parts 152, and the sealing part 151 is located between the synchronizing parts 152.

In this embodiment, the returning mechanism 154 is a spring mechanism. The returning mechanism 154 is connected to the base portion 153 and provides a pressure that enables the sealing part 151 to continuously closely contact the peripheral surface 121. It should be understood that the returning mechanism 154 also provides a pressure that enables the synchronizing parts 152 to continuously closely contact the cam surfaces 131.

The rotor 12 and the cams 13 rotate, and the synchronizing parts 152 move according to the corresponding cam surfaces 131, so that the sealing part 151 moving in synchronization continuously closely contacts the peripheral surface 121. The gas enters the chamber 111 from the air inlet portion 113, after which the convex surface 122 of the rotor 12 rotates to seal the air inlet portion 113, the sealing part 151, the convex surface 122, and the inner surface of the chamber 111 form a substantially hermetic space, and the rotating rotor 12 continuously compresses the gas in the chamber 111 until it reaches a set pressure, after which the gas in the chamber 111 is guided out through the air outlet portion 114.

Referring to FIG. 1B and FIG. 1C, and FIG. 2 to FIG. 4 for illustration, when the cam surfaces 131 rotate to the right, the cam surfaces 131 push the synchronizing part 152 to move to the right, the sealing part 151 shifts in synchronization with the synchronizing parts 152, so that the sealing part 151 moves to the right at the same time. Here, the convex surface 122 of the rotor 12 moves to the right in synchronization, in which a shift amount is the same as a shift amount of rightward motion of the sealing part 151, and the returning mechanism 154 provides a downward pressure for the sealing part 151, so that the sealing part 151 may continuously closely contact the peripheral surface 121.

In contrast, when the cam surface 131 rotates to the left, the returning mechanism 154 provides a left pressure for the sealing part 151, the synchronizing parts 152 respectively continuously contact the cam surface 131 and continuously move to the left, the sealing part 151 shifts in synchronization with the synchronizing parts 152, so that the sealing part 151 moves to the left at the same time. Here, the convex surface 122 of the rotor 12 moves to the left in synchronization, in which a shift amount is the same as a shift amount of leftward motion of the sealing part 151, and the returning mechanism 154 provides a left pressure for the sealing part 151, so that the sealing part 151 may continuously closely contact the peripheral surface 121.

In this embodiment, during an operation procedure, the rotor 12 and the cams 13 have the same rotation speed, the shapes of the cam surfaces 131 of the cams 13 are in cooperation with the shape of the peripheral surface 121 of the rotor 12 (the rotor 12 and the cam 13 have the same line type), and the cams 13 rotate in cooperation with the rotor 12.

Figure 2:
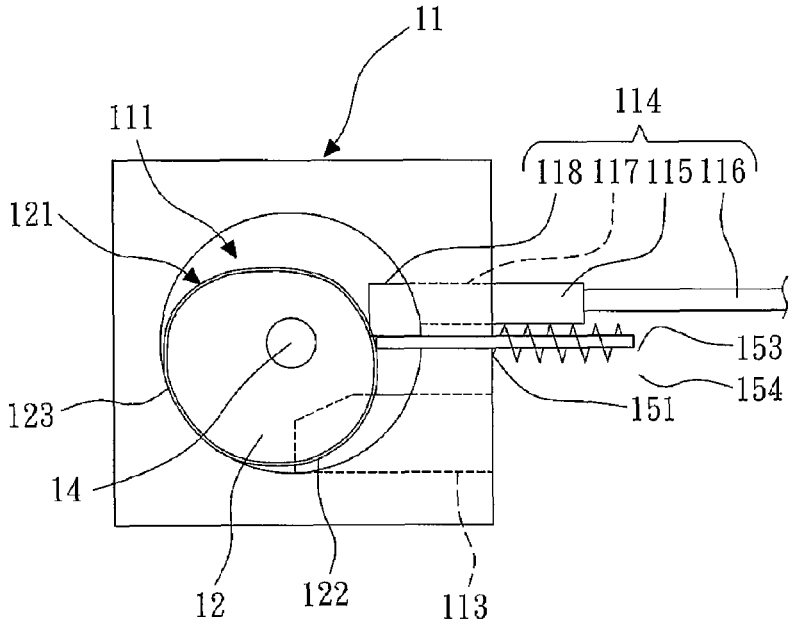
FIG. 2 to FIG. 4 are schematic views of a compression stroke of the rotor type pump according to the first embodiment of the present invention.
Figure 3:
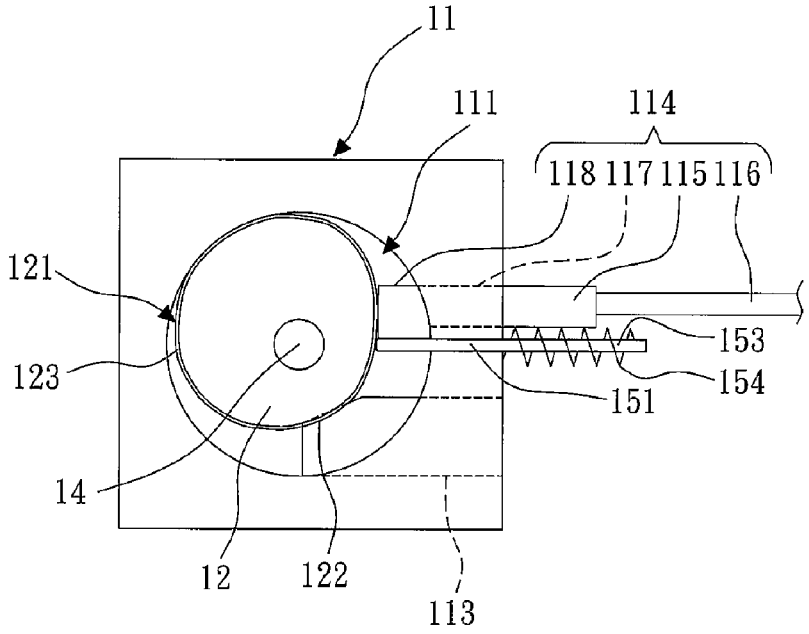
Figure 4:
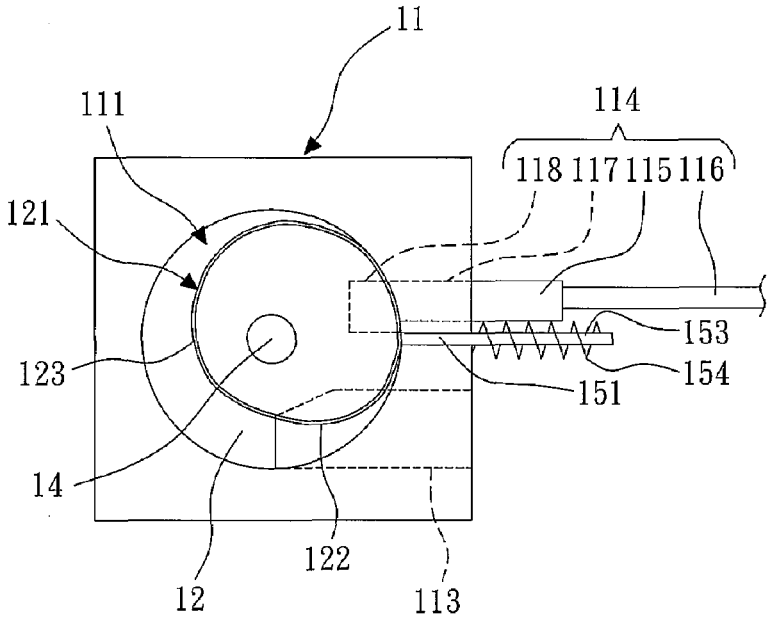

When the convex surface 122 does not seal the air inlet portion 113 (as shown in FIG. 4), the gas enters the chamber 111 from the air inlet portion 113; when the convex surface 122 seals the air inlet portion 113 (as shown in FIG. 1B), the compression stroke is started. During the compression stroke, the sealing part 151, the convex surface 122, and the inner surface of the chamber 111 form a substantially hermetic space, the rotor 12 continuously rotates to make the hermetic space become increasingly smaller (as shown in FIG. 2 to FIG. 3), until the gas in the chamber 111 is compressed to a set pressure, at which time the check valve 115 of the air outlet portion 114 releases the compressed gas that has reached the set pressure out from the chamber 111 (the set pressure varies with different check valves); during the compression stroke, as the rotor 12 continuously rotates, the position of the convex surface 122 is changed so that it does not completely cover the air inlet portion 113, thereby generating an air inlet space in the chamber 111 (as shown in FIGS. 2 to 4) to allow the uncompressed gas to enter the air inlet space from the air inlet portion 113; when the rotor 12 rotates to cover the air inlet portion 113 again (as shown in FIG. 1B), the air inlet stroke is ended, and the compression is started, so as to perform a next compression stroke.

It should be noted that the cross-section size of the interconnection channel 118 is preferably greater than the cross-section size of the out connection channel 117, so that during the compression stroke, when the rotor 12 continuously rotates until the convex surface 122 almost totally covers an opening of the interconnection channel 118 (that is, the set pressure is achieved), the check valve 115 is opened, so that the compressed gas is guided out from the chamber 111. In this manner, the space of the chamber 111 is totally utilized, thus enhancing gas compression performance.

Figure 5:
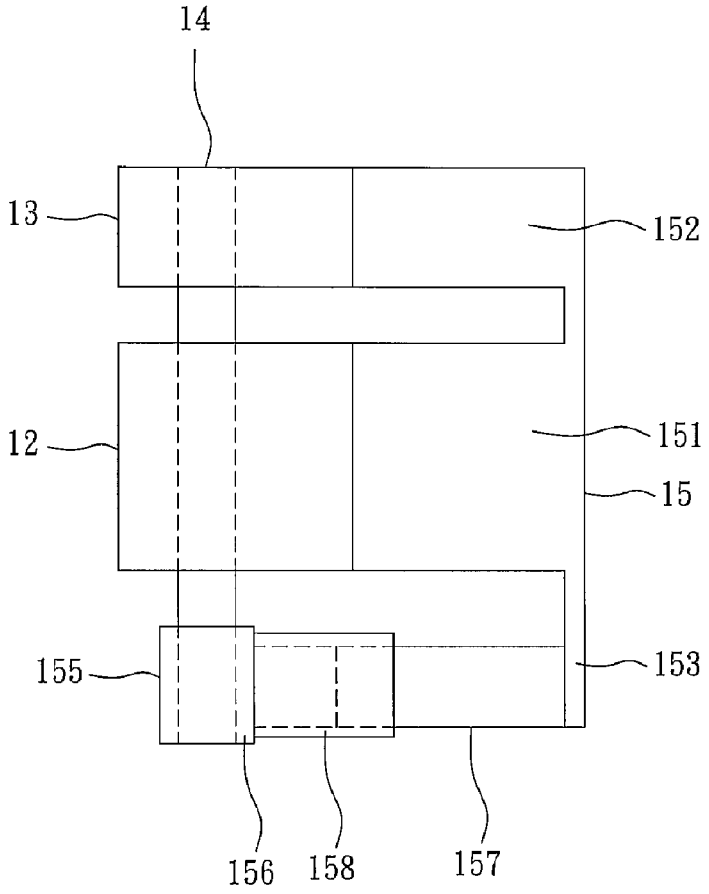
FIG. 5 is a schematic view of cooperation of a sealing unit having a linear guiding device and a rotor and cams in the rotor type pump according to the first embodiment of the present invention.

Referring to FIG. 1A and FIG. 5, in other applications, the sealing unit 15 may further include at least one linear guiding device 155. Each linear guiding device 155 includes a linear bearing 156 and a guide shaft 157, and the linear bearing 156 is pivoted to the rotating shaft 14 and has a guiding portion 158. The guide shaft 157 is disposed on one side of the sealing part 151 and is connected to the base portion 153, and moves in synchronization with the sealing part 151 and the synchronizing part 152 according to the guiding portion 158.

The rotor type pump 1 of the present invention may also be applied to forming a negative pressure environment (for example, used to form a negative pressure environment or a vacuum state); this means that the rotor type pump 1 of the present invention can be used to perform "compression" and "vacuum pressure discharge." The air inlet portion 113 is connected to a space or a device (not shown in the drawings) intending to form the negative pressure environment or the vacuum state. When the rotor 12 continuously rotates and the convex surface 122 does not totally cover the air inlet portion 113, the air inlet space in the chamber 111 is continuously increased (as shown in FIG. 2 to FIG. 4); the air inlet space forms the negative pressure state (relative to the space or the device intending to form the negative pressure environment or the vacuum state), and the gas in the space or the device intending to form the negative pressure environment or the vacuum state is absorbed into the air inlet space. When the rotor 12 rotates to cover the air inlet portion 113 again (as shown in FIG. 1B), a next gas absorbing procedure is ready to be performed, so as to achieve the function of the negative pressure environment or the vacuum state.

Figure 6:
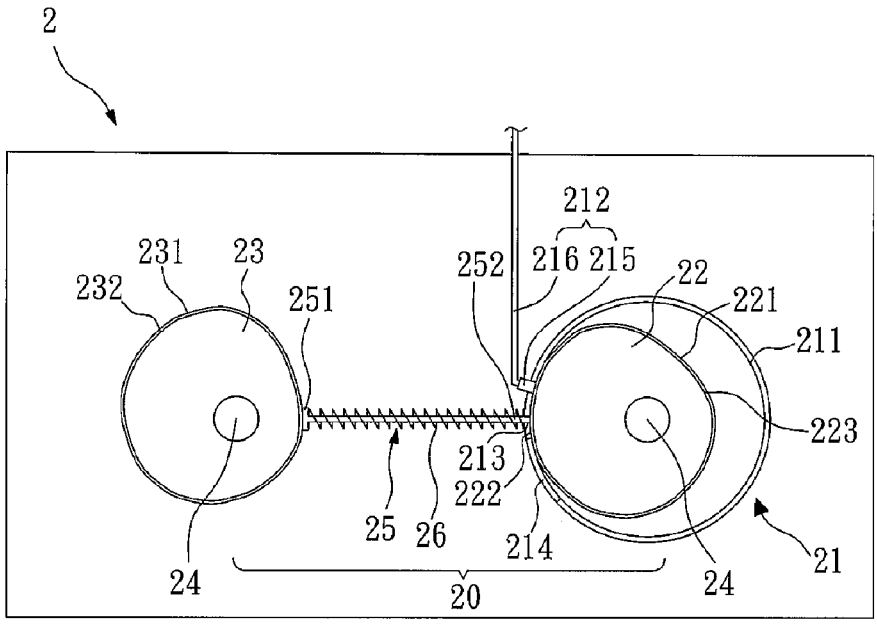
FIG. 6 is a schematic view of a rotor type pump according to a second embodiment of the present invention.
Figure 7:
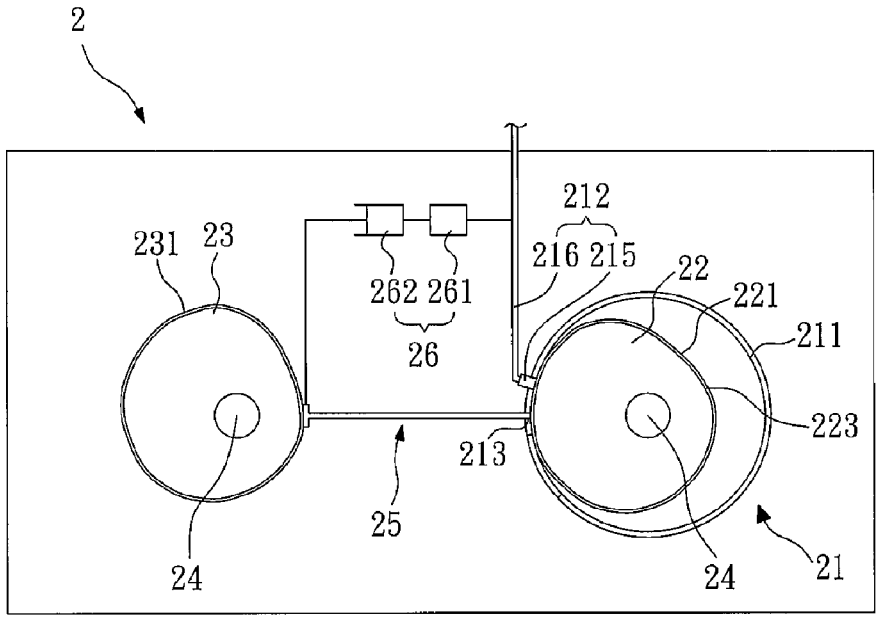
FIG. 7 is a schematic view of a returning mechanism having a pressure regulating valve and a piston structure of the rotor type according to the second embodiment of the present invention.

FIG. 6 is a schematic view of a rotor type pump according to a second embodiment of the present invention. In this embodiment, the rotor type pump 2 includes a body 21, a rotor 22, a cam 23, two rotating shafts 24, a sealing unit 25, and a returning mechanism 26.

The body 21 has a chamber 211, an air outlet portion 212, a disposing opening 213, and an air inlet portion 214, in which the disposing opening 213 is formed between the air outlet portion 212 and the air inlet portion 214. The rotor type pump 2 according to the second embodiment of the present invention includes at least one compression unit. In this embodiment, the rotor type pump 2 has a compression unit 20, which includes a chamber 211, an air outlet portion 212, a disposing opening 213, an air inlet portion 214, a rotor 22, a cam 23, two rotating shafts 24, a sealing unit 25, and a returning mechanism 26. In this embodiment, the chamber 211, air outlet portion 212, disposing opening 213, and air inlet portion 214 form a structure of a cylinder.

In this embodiment, the body 21 is a hollow circular cylinder, and may also be understood to be the structure having the hollow circular cylinder chamber as shown in FIG. 1A to FIG. 1C. In this embodiment, the air outlet portion 212 has a check valve 215 and a pipeline 216. The check valve 215 communicates with the chamber 211, so that a gas may be guided out from the chamber 211 and cannot enter the chamber 211 reversely, and the pipeline 216 is connected to the check valve 215, for guiding the gas guided out from the chamber 211.

The rotor 22 is axially disposed in the chamber 211 along an axis line of the body 21 (also called an axis line of the chamber 211) through a rotating shaft 24. The rotor 22 has a peripheral surface 221, which has a convex surface 222 that closely contacts an inner wall of the chamber 211. In this embodiment, the rotor 22 and the cam 23 are of a heteroaxial and conjugating type (line types of the rotor 22 and the conjugating cam 23 compensate each other). The cam 23 is disposed on another rotating shaft 24 and the axis line is substantially parallel with the axis line of the body 21, and the cam 23 has a cam surface 231. At least one of the rotor 22 and the cam 23 further has a cover layer.

In this embodiment, the rotor 22 has a cover layer 223 and the cam 23 also has a cover layer 232. In other applications, only the rotor 22 has a cover layer, or only the cam 23 has a cover layer. Preferably, the cover layers 223 and 232 are of a Teflon material.

The sealing unit 25 penetrates the disposing opening 213 and is located between the rotor 22 and the cam 23. In this embodiment, the sealing unit 25 is substantially perpendicular to the axis line of the cam 23 and a direction of the axis line of the chamber 211, in which the sealing unit 25 and the disposing opening 213 are well adapted for maintaining close contact. In this embodiment, the sealing unit 25 has a first part 251 (that is, the synchronizing part 152 in the first embodiment) and a second part 252 (that is, the sealing part 151 in the first embodiment); the first part 251 contacts the cam surface 231, the first part 251 and the second part 252 are substantially in a T shape, and one end of the second part 252 contacts the peripheral surface 221.

The returning mechanism 26 is connected to the sealing unit 25, and is used to provide a returning force enabling the sealing unit 25 to move toward the cam 23. Preferably, the returning mechanism 26 is an elastic element. In this embodiment, the elastic element is a spring, and is sleeved on the second part 252 of the sealing unit 25 between the cam 23 and the body 21.

In this embodiment, during an operation procedure, the rotor 22 and the cam 23 respectively have a rotating speed, and shapes of the peripheral surface 221 of the rotor 22 and the cam surface 231 of the cam 23 are designed according to a size of the sealing unit 25, the rotating speeds of the rotor 22 and the cam 23, and a distance between the rotor 22 and the cam 23. The cam 23 rotates in cooperation with the rotor 22, and the first part 251 of the sealing unit 25 drives the sealing unit to move towards the rotor 22 according to the shape of the cam surface 231, so that the second part 252 of the sealing unit 25 continuously closely contacts the peripheral surface 221.

Figure 8:
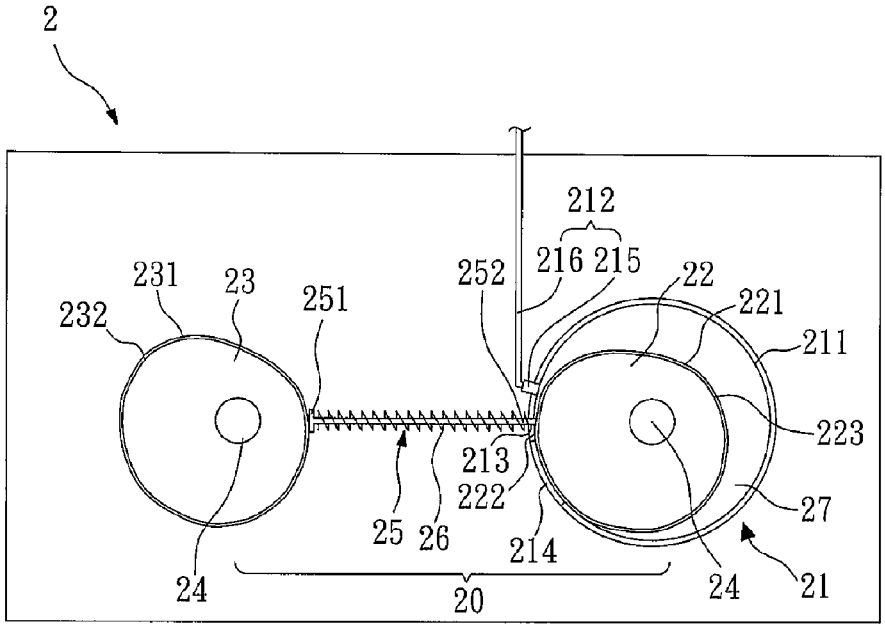
FIGS. 8 to 10 are schematic views of a compression stroke of the rotor type pump according to the second embodiment of the present invention.
Figure 9:
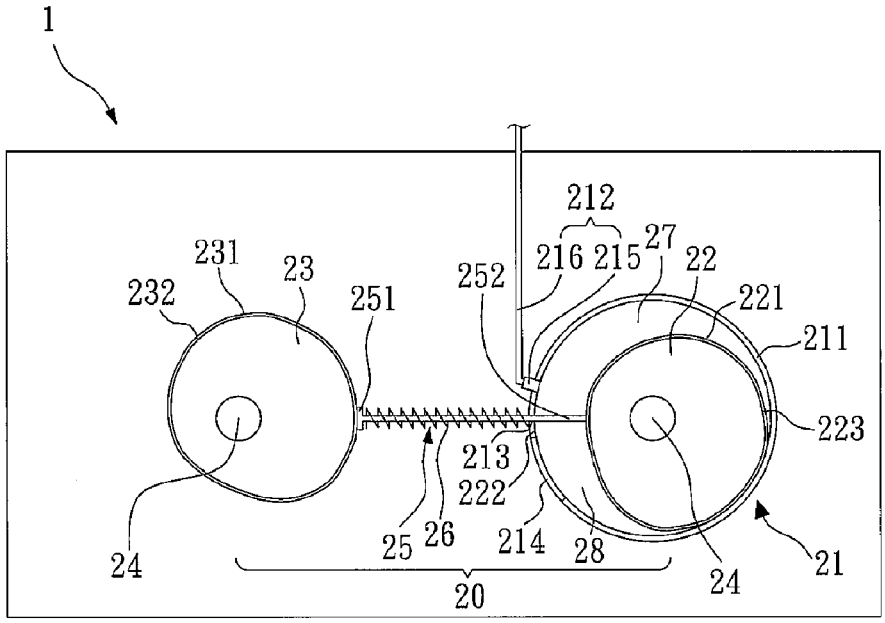
Figure 10:
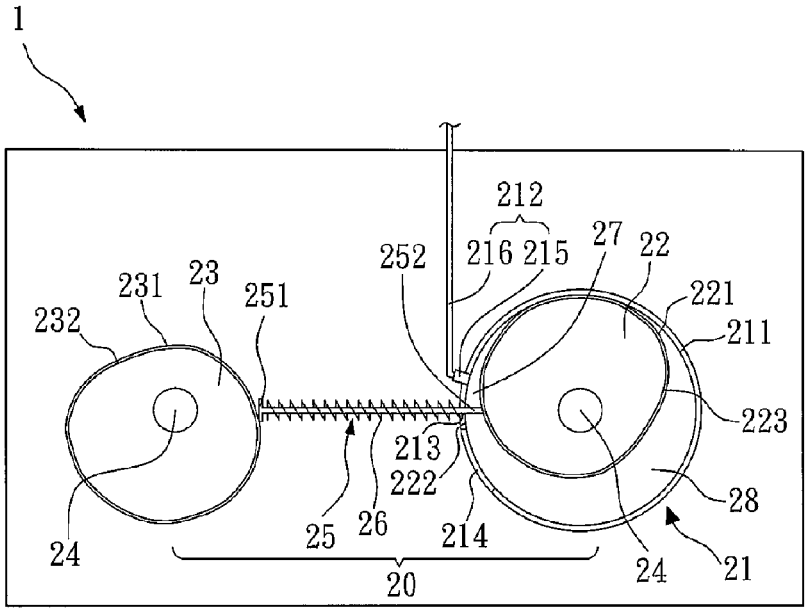

When the convex surface 222 does not seal the air inlet portion 214 (as shown in FIG. 6, FIG. 9, and FIG. 10), the gas enters the chamber 211 from the air inlet portion 214; when the convex surface 222 seals the air inlet portion 214 (as shown in FIG. 8), the compression stroke is started. During the compression stroke, the second part 252 of the sealing unit 25, the convex surface 222, and the inner surface of the chamber 211 form a substantially hermetic space, the rotor 22 continuously rotates to make the hermetic space become increasingly smaller (as shown in FIG. 8 to FIG. 10) until the gas in the chamber 211 is compressed to a set pressure, at which time the check valve 215 of the air outlet portion 212 releases the compressed gas that has reached the set pressure out from the chamber 211 (the set pressure varies with different check valves); during the compression stroke, when the rotor 22 continuously rotates, the position of the convex surface 222 is changed so that it does not completely cover the air inlet portion 214, thereby generating an air inlet space 28 in the chamber 211 (as shown in FIG. 9 and FIG. 10) to allow the uncompressed gas to enter the air inlet space 28 from the air inlet portion 214; when the rotor 22 rotates to cover the air inlet portion 214 again (as shown in FIG. 8), a next compression stroke is performed.

The rotor type pump 2 of the present invention may also be applied to forming a negative pressure environment (for example, to form a negative pressure environment or a vacuum state); this means that the rotor type pump 2 of the present invention can be used to perform "compression" and "vacuum pressure discharge." The air inlet portion 214 is connected to a space or a device (not shown in the drawings) intending to form the negative pressure environment or the vacuum state. When the rotor 22 continuously rotates to perform the compression stroke and the convex surface 222 does not totally cover the air inlet portion 214, the air inlet space in the chamber 211 is continuously increased (as shown in FIG. 9 and FIG. 10); the air inlet space 28 forms the negative pressure state (relative to the space or the device intending to form the negative pressure environment or the vacuum state), and the gas in the space or the device intending to form the negative pressure environment or the vacuum state is absorbed into the air inlet space 28. When the rotor 22 rotates to cover the air inlet portion 214 again (as shown in FIG. 8), a next gas absorbing procedure is ready to be performed, so as to achieve the function of the negative pressure environment or the vacuum state.

In addition, referring to FIG. 6 and FIG. 8, in other applications, the returning mechanism 26 may include a pressure regulating valve 261 and a piston structure 262, in which the pressure regulating valve 261 is connected to the pipeline 216, the piston structure 262 is connected to the pressure regulating valve 261 and the sealing unit 25, and the passing gas pressure is controlled by the pressure regulating valve 261, so as to drive the piston structure 262 to move together with the sealing unit 25. Further, through control of the pressure regulating valve 261, the compressed gas generated during compression may be used to keep the pressure required by the piston structure 262. After the compressed gas generated during the compression stroke is discharged to the pipeline 216, a part of the gas passes through the pressure regulating valve 261 and reaches the piston structure 262, thereby having an automatic gas compensation function.

When the sealing unit 25 moves towards the rotor 22, the sealing unit 25 shifts through a push force generated by the cam 23, and in cooperation with the relation of the gas pressure in the piston structure 262, an optimal moving position of the sealing unit 25 is calculated. When the sealing unit 25 moves towards the cam 23, the rotor 22 and the gas pressure in the piston structure 262 provide a push force for the sealing unit 25; in addition, the returning mechanism 26 further provides a returning force for enabling the sealing unit 25 to shift, so as to keep a slave driving relation of the sealing unit 25 and the cam surface 231. The shift returning force provided by the returning mechanism 26 may reduce a friction force between the sealing unit 25 and the rotor 22, so as to reduce abrasion and improve working efficiency.

Figure 11:
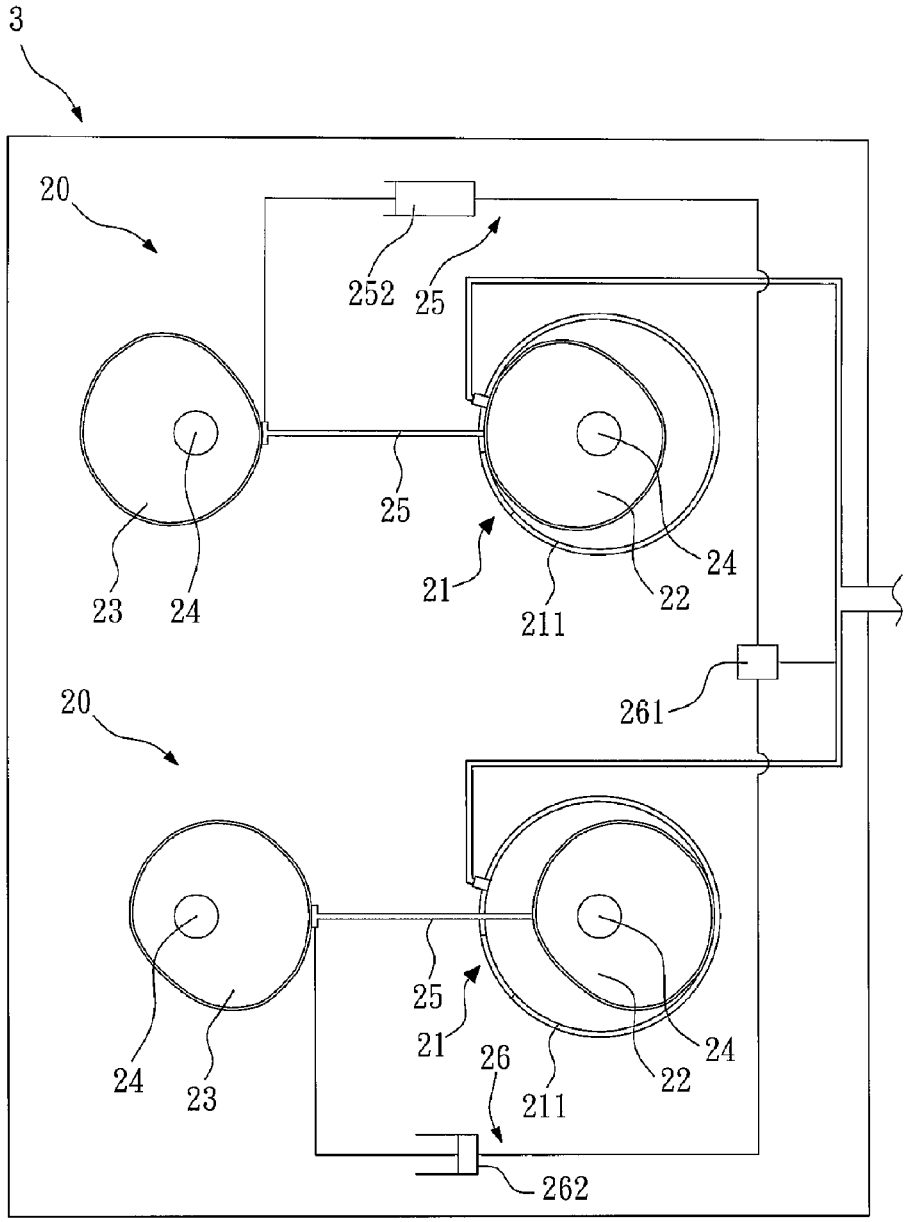
FIG. 11 is a schematic view of a rotor type pump according to a third embodiment of the present invention.

FIG. 11 is a schematic view of a rotor type pump according to a third embodiment of the present invention. It is different from the rotor type pump 2 of the second embodiment in that the rotor type pump 3 of the third embodiment has a plurality of (two) compression units 20. In this embodiment, there is a phase difference produced between the rotors 22 of the compression units 20, and the returning mechanism 26 has a pressure regulating valve 261 and a piston structure 262; piston structures 262 of the returning mechanisms 26 may be connected to the same pressure regulating valve 261 (and may also be connected to different pressure regulating valves), and the pressure regulating valve 261 controls and distributes the gas pressure entering the piston structures 262.

In this embodiment, the rotors 22 of the compression unit 20 have a phase difference of 180 degrees; for example, in FIG. 11, the rotor 22 in the upper part of the drawing contacts an inner wall of the chamber 211 on a left side, and the other rotor 22 on the lower part of the drawing contacts an inner wall of the chamber 211 on a right side. For detailed description of other means of the third embodiment, reference is made to the description of the same means in the second embodiment, which is not repeated here.

Compared with the rotor type pump 2 of the second embodiment, the rotor type pump 3 of the third embodiment has two compression units 20, and the rotors 22 of the compression units 20 have a phase difference, so that the compression units 20 finish the gas compression stroke with a time interval, thereby providing compressed gas more steadily and in greater quantity, or more efficiently enabling a space or a device to achieve a negative pressure environment or a vacuum state. Naturally, the rotor type pump 3 of the third embodiment may have more compression units depending on the demands of the devices connected to it.

In the rotor type pump of the present invention, the smooth surface of the rotor closely contacts the inner surface of the chamber of the body, and the gas in the chamber is compressed in a rotational manner, in which the rotor of the present invention does not require to-and-fro movement like a piston, and a dead point is prevented, so that operation is smooth and relatively little noise is generated. Further, the rotor type pump of the present invention may include a lubricating and heat-resistant cover layer on the surface of the rotor to eliminate the need for lubricating fluid, and offers high compression capacity and excellent efficiency.

While the embodiments of the present invention have been illustrated and described, various modifications and improvements can be made by those skilled in the art. The embodiments of the present invention are therefore described in an illustrative but not restrictive sense. It is intended that the present invention is not limited to the particular forms as illustrated, and that all modifications that maintain the spirit and scope of the present invention are within the scope defined in the appended claims.

What is claimed is:

1. A rotor type pump, comprising:

a body, having a chamber, an air inlet portion, and an air outlet portion;

a rotor, axially disposed in the chamber, and having a peripheral surface, wherein the peripheral surface at least has a convex surface, and the convex surface closely contacts an inner surface of the chamber;

at least one cam, each cam having a cam surface, and rotating in cooperation with the rotor; and a sealing unit, having a sealing part and at least one synchronizing part, wherein the sealing part contacts the peripheral surface, the synchronizing part contacts the cam surface, and the sealing part moves in synchronization with the synchronizing part;

wherein the rotor and the cam rotate, the synchronizing part moves according to the corresponding cam surface, so that the sealing part moving in synchronization continuously closely contacts the peripheral surface; a gas enters the chamber from the air inlet portion, and the sealing part, the convex surface, and the inner surface of the chamber form a substantially hermetic space after the convex surface rotates to seal the air inlet portion; and the rotating rotor continuously compresses the gas in the chamber until a set pressure is reached, at which time the gas in the chamber is guided out from the air outlet portion.

2. The rotor type pump according to claim 1, wherein the body further comprises at least one accommodating space disposed on one side of the chamber, the sealing part penetrates the body and contacts the peripheral surface, and the synchronizing part respectively penetrates the body and respectively contacts the cam surface.

3. The rotor type pump according to claim 1, wherein the body comprises two accommodating spaces, the rotor type pump comprises two cams and two synchronizing parts, the accommodating spaces are disposed on two sides of the chamber, the sealing part penetrates the body and contacts the peripheral surface, and the synchronizing parts respectively penetrate the body and respectively contact the cam surface.

4. The rotor type pump according to claim 1, further comprising a rotating shaft, which is connected to the rotor and the cam.

5. The rotor type pump according to claim 4, wherein the sealing unit further comprises at least one linear guiding device, the linear guiding device comprises a linear bearing and a guide shaft, the linear bearing is pivoted to the rotating shaft and has a guiding portion, and the guide shaft is disposed on one side of the sealing part and moves in synchronization with the sealing part according to the guiding portion.

6. The rotor type pump according to claim 4, further comprising at least one weighting element, which is used to balance rotation, so as to improve a rotation speed.

7. The rotor type pump according to claim 1, wherein the air outlet portion has a check valve and a pipeline, the check valve communicates with the chamber, and the pipeline is connected to the check valve.

8. The rotor type pump according to claim 1, wherein the sealing unit further comprises a base portion and a returning mechanism, the base portion is connected to the sealing part and the synchronizing part, the returning mechanism is connected to the base portion, and the returning mechanism provides a pressure that enables the sealing part to continuously and closely contact the peripheral surface.

9. The rotor type pump according to claim 1, wherein the body further comprises a disposing opening formed between the air outlet portion and the air inlet portion, an axis line of the cam is parallel with an axis line of the chamber, the sealing unit penetrates the disposing opening and is between the rotor and the cam, the sealing unit is perpendicular to the axis line of the cam and a direction of the axis line of the chamber, the sealing part and the synchronizing part are located on two ends of the sealing unit, and the cam drives the synchronizing part, so that the sealing part continuously and closely contacts the peripheral surface.

10. The rotor type pump according to claim 9, wherein the air outlet portion has a check valve and a pipeline, the check valve communicates with the chamber, and the pipeline is connected to the check valve.

11. The rotor type pump according to claim 9, wherein the synchronizing part contacts the cam surface, and the synchronizing part and the sealing part are in a T shape.

12. The rotor type pump according to claim 9, further comprising at least one compression unit, which has a returning mechanism that is connected to the sealing unit and is used to provide a returning force enabling the sealing unit to move toward the cam.

13. The rotor type pump according to claim 12, wherein the returning mechanism further comprises a pressure regulating valve and a piston structure, the pressure regulating valve is connected to the air outlet portion, and the piston structure is connected to the pressure regulating valve and is moved together with the sealing unit.

14. The rotor type pump according to claim 9, further comprising at least one compression unit, wherein each compression unit has one chamber, one air outlet portion, one disposing opening, one air inlet portion, one rotor, one cam, and one sealing unit.

15. The rotor type pump according to claim 14, further comprising a plurality of compression units, wherein there is a phase difference produced between the rotors of the compression units.

* * * * *